United States Patent [19]

Ferguson et al.

[11] 4,168,765

[45] Sep. 25, 1979

[54] HAND CLIMBER FOR USE WITH TREE CLIMBING PLATFORM

[76] Inventors: Clarence E. Ferguson, Rte. 2, Box 404; Ernie B. Ferguson, Rte. 2, Box 403-C, both of Hartselle, Ala. 35640; Jerry C. Ferguson, 2608 Rainier Dr., Birmingham, Ala. 35215

[21] Appl. No.: 947,647

[22] Filed: Oct. 2, 1978

[51] Int. Cl.[2] ..... A63B 27/02

[52] U.S. Cl. ..... 182/135; 182/187

[58] Field of Search ..... 182/133, 134, 135, 136, 182/230, 187

[56] References Cited

U.S. PATENT DOCUMENTS

| | | | |
|---|---|---|---|
| 1,441,806 | 1/1923 | Hoitsma | 182/136 |
| 2,392,538 | 1/1946 | Knudsen | 182/134 |
| 3,156,465 | 11/1964 | Jacobi | 182/136 |
| 3,856,111 | 12/1974 | Baker | 182/135 |
| 3,955,645 | 5/1976 | Dye | 182/135 |

*Primary Examiner*—Reinaldo P. Machado

*Attorney, Agent, or Firm*—Woodford R. Thompson, Jr.

[57] ABSTRACT

A hand climber for use with a foot actuated tree climbing platform embodying an elongated bar slidably connected to the forward ends of a first pair of links which extend along opposite sides of the tree. A second pair of links extend forwardly along opposite sides of the tree with the forward ends thereof being pivotally connected to the rearwardly extending ends of the first pair of links. The rear ends of the second pair of links are pivotally connected to each other whereby all of the links are movable to adjust themselves to the contour of the tree and are movable to extended and collapsed positions.

6 Claims, 5 Drawing Figures

Fig 1
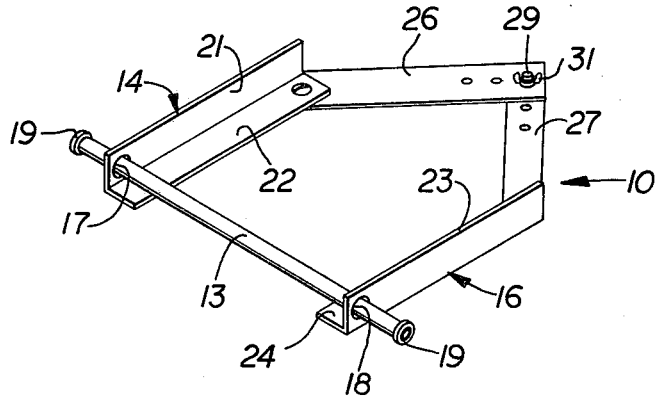
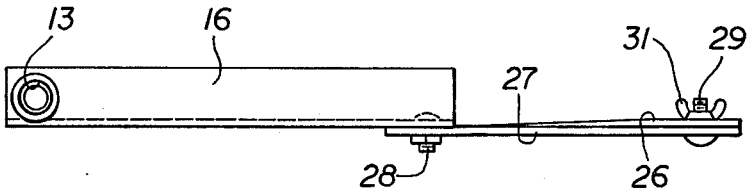
Fig 2
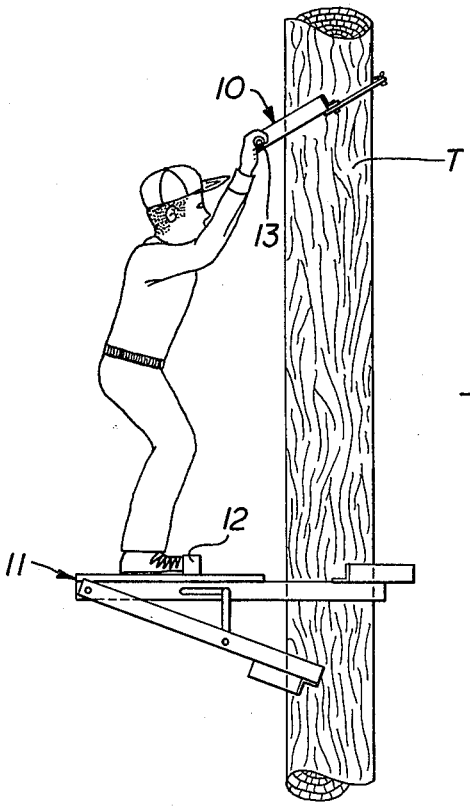
Fig 3

HAND CLIMBER FOR USE WITH TREE CLIMBING PLATFORM

BACKGROUND OF THE INVENTION

This invention relates to a hand climber which is adapted for use with conventional type foot actuated tree climbing platforms of the type shown in U.S. Pat. No. 3,856,111 and 3,955,645. These patents also show conventional type hand climber members. A tree climbing platform is also shown in the Ferguson et al U.S. patent application Ser. No. 762,243, filed Jan. 25, 1977.

As is well known in the art to which our invention relates, difficulties have been encountered in actuating hand climbers which are used with foot actuated tree climbing platforms due to the fact that they either consisted of metal frame members which were rigidly secured to each other or consisted of a forwardly projecting handle connected to a flexible strap or loop which surrounded the tree. Where rigid metal frame members are employed, oppositely disposed blade members engage the tree at the points of contact between the rigid blades and the tree whereby the blades cut into the tree to thus secure the hand climber in place. This not only makes the hand climber difficult to operate but also causes considerable damage to the tree. Where a flexible loop is carried by a forwardly extending handle member, it is difficult to move the loop to selected positions along the tree due to the fact that it is difficult to engage and then disengage such a loop about a tree by manipulating a forwardly extending handle bar. This handle bar projects toward the face of the user of the device whereby it is difficult for the user to pull his legs up along with the tree climbing platform. This is especially true in view of the fact that the hands of the user are grasping a bar which projects from the tree directly toward the user whereby the body of the user would have a tendency to move laterally or rock relatively to the adjacent side of the tree as the user supports himself and the tree climbing platform from the hand climber.

SUMMARY OF THE INVENTION

In accordance with our invention, we overcome the above and other difficulties encountered in hand climbers for foot actuated tree climbing platforms by providing an elongated bar which extends transversely of the side of the tree and is slidably connected to the forward ends of a first pair of links which in turn extend along opposite sides of the tree. The rear ends of the first pair of links are pivotally connected to the forward ends of a second pair of links which extend alongside the tree with the rear ends of the second pair of links being pivotally connected to each other. Accordingly, adjacent components of our improved hand climber are pivotally connected to each other. Accordingly, adjacent components of our improved hand climber are pivotally connected to each other whereby they adjust themselves to the contour of the tree to thus encompass and grip the tree upon downward movement of the transverse bar.

An object of our invention is to provide a hand climber for use with a tree climbing platform which shall be simple of construction, economical of manufacture and one which may be assembled and disassembled with a minimum of effort and without damage to the tree.

Another object of our invention is to provide a hand climber for use with a tree climbing platform which not only is adjustable at the time the hand climber is installed to accommodate trees of various diameters but one which may be readily adjusted by the user as he moves up or down the tree to compensate for differences in diameter at various locations along the tree.

A further object of our invention is to provide a hand climber of the character designated which may be readily moved to an extended position and a collapsed position whereby a minimum of space is required for storage and shipment.

DESCRIPTION OF THE DRAWINGS

A hand climber embodying features of our invention is illustrated in the accompanying drawings, forming a part of this application, in which:

FIG. 1 is a perspective view showing the hand climber in extended, operating position;

FIG. 2 is an enlarged, side elevational view thereof;

FIG. 3 is a side elevational view, drawn to a smaller scale, showing our improved hand climber and a tree climbing platform in the operating position on a tree;

DETAILED DESCRIPTION

Figure 4:
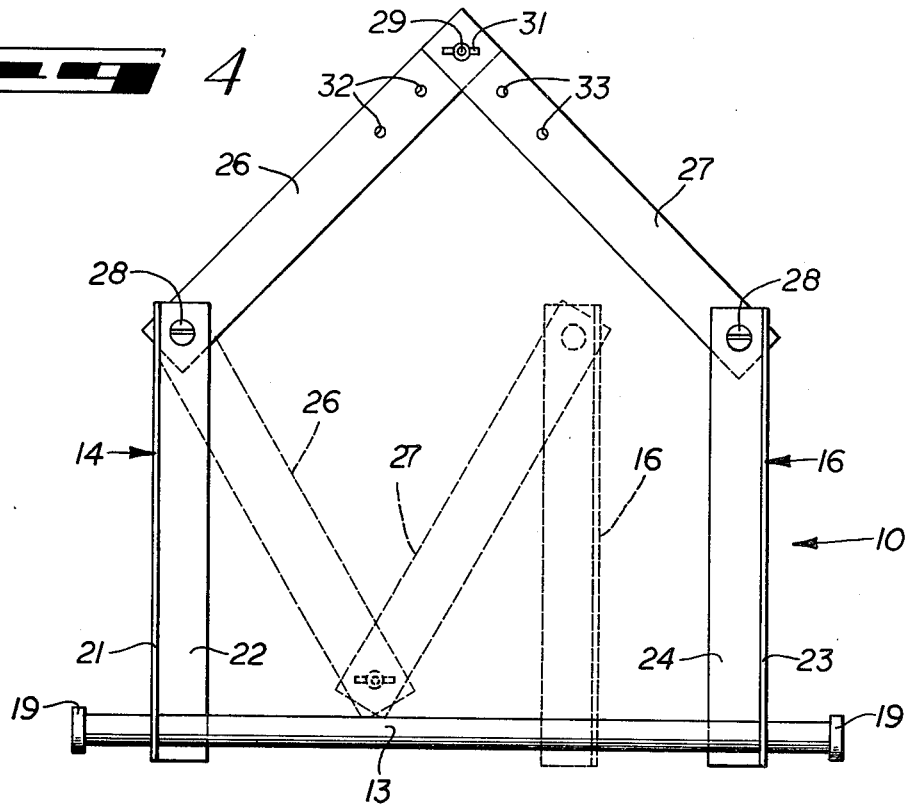
FIG. 4 is an enlarged, plan view showing the hand climber in the operating, extended position in solid lines and in an intermediate, collapsed position in dotted lines; and, FIG. 5 is a top plan view corresponding to FIG. 4 but showing the hand climber attached to a tree, the tree being shown in dotted lines.

Referring now to the drawings for a better understanding of our invention, we show our improved hand climber generally at 10 which is adapted to be positioned on a tree T above a tree climbing platform indicated generally at 11. The tree climbing platform 11 may be of a conventional type wherein the person, such as a hunter, stands on the platform with his feet engaged in foot straps 12 and his hands grasping the hand climber 10 lifts or lowers the platform 11. That is, when it is desired to raise or lower the platform 11 along the tree T the hand climber 10 and the platform 11 are operated alternately.

Figure 5:
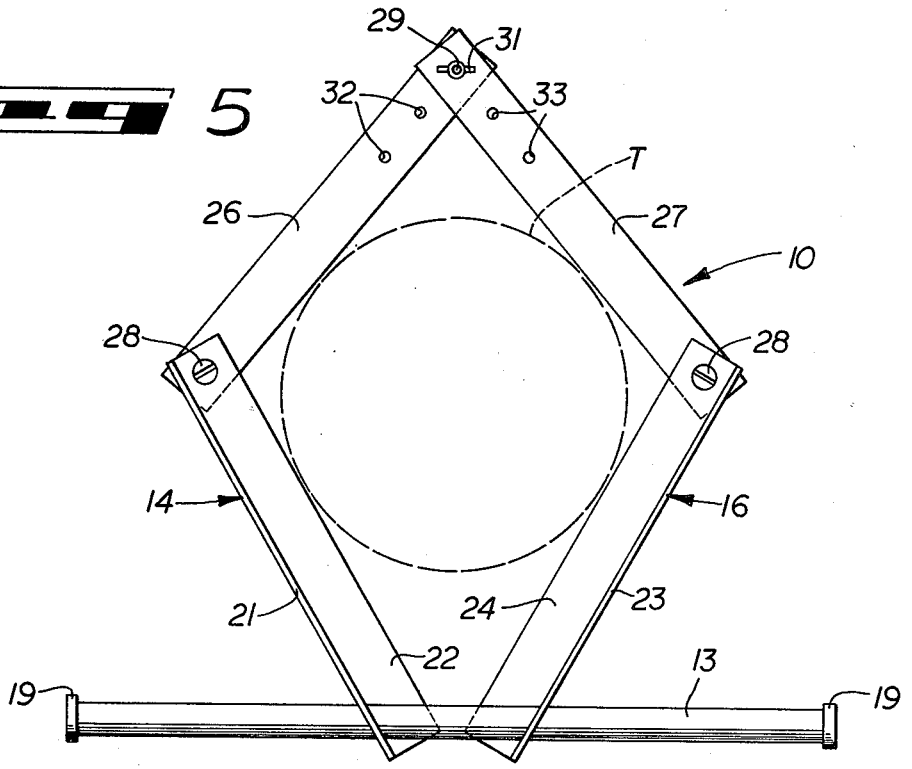

Our improved hand climber comprises an elongated bar 13 which is adapted to extend transversely of the front side of the tree T above the platform 11, as shown. A first pair of links embodying individual links 14 and 16 are slidably connected at their forward ends to the elongated bar 13 whereby the forward end of each link 14 and 16 is movable to selected positions along the elongated bar 13. Through openings 17 and 18 are provided in the forward ends of the links 14 and 16, respectively, for receiving the elongated bar 13, as shown. To prevent accidental separation of the elongated bar 13 from the links 14 and 16, suitable end cap members 19 may be attached to each end of the elongated bar 13. As clearly shown in FIG. 1, each of the links 14 and 16 is L-shaped, as viewed in cross section. That is, the link 14 is provided with a vertical flange 21 and a horizontal flange 22 while the link 16 is provided with a vertical flange 23 and a horizontal flange 24. The vertical flanges 21 and 23 are provided with the openings 17 and 18, respectively, for receiving the elongated bar 13 while the horizontal flanges 22 and 24 are in position to engage the sides of a tree T, as shown in FIG. 5.

Individual links 26 and 27 of a second pair of links are pivotally connected at their forward ends to the rear ends of the links 14 and 16, respectively, by suitable pivot pins 28. The links 26 and 27 of the second pair of links are also adapted to extend along opposite sides of the tree T, as shown in FIG. 5. The rear ends of the links 26 and 27 are pivotally connected to each other by suitable means, such as a bolt 29 having a wing nut 31, whereby the rear ends of the links 26 and 27 are detachably connected to each other. Longitudinally spaced openings 32 are provided in rear portions of the link 26 which are adapted to move into alignment with selected longitudinally spaced openings 33 provided in the rear portion of the link 27 whereby the effective length of the links 26 and 27 may be varied to accommodate trees of different diameters. As shown in FIGS. 1 and 2, each of the links 26 and 27 is formed of a flat material which extends in a generally horizontal plane whereby the links 26 and 27 are movable relative to each other to an extended position, as shown in dotted lines in FIG. 4. That is, the links 26 and 27 are adapted to pivot relative to each other and relative to the links 14 and 16 from the solid line position to the dotted line position shown in FIG. 4 while the links 14 and 16 are adapted to move to selected positions along the elongated bar 13. While we have shown the links 26 and 27 and the link 16 in the partially collapsed position in FIG. 4, it will be apparent that upon movement of the link 16 alongside the link 14, the links 26 and 27 would then move generally parallel to the links 14 and 16 whereby the overall unit would assume a minimum of space.

From the foregoing description, the operation of our improved hand climber for use with a tree climbing platform will be readily understood. The hand climber 10 is attached to a tree T above the tree climbing platform 11, as shown in FIG. 3 by either removing one of the end caps 19 whereby the elongated bar 13 may be detached from one of the links 14 or 16 to thus position the hand climber around the tree T. Also, the wing nut 31 may be removed from the bolt 29 to thus separate the rear ends of the links 26 and 27 whereby the hand climber could be inserted around the tree and the bolt 29 and wing nut 31 replaced. After installation on the tree T, the user operates the hand climber and platform alternately to raise or lower the platform 11. That is, the user grips the elongated bar 13 with his hands while his feet are inserted in the straps 12 carried by the platform 11. It will be noted that the elongated bar 13 projects beyond the ends of the links 14 and 16 to provide a hand gripping portion. With the user thus standing on the platform 11, he can adjust the hand climber 10 to a higher or lower elevation on the tree T. The user then hangs from the elongated bar 13 and then either lifts or lowers his feet to raise or lower the platform 11 relative to the tree T. This operation is alternately repeated until the desired level of the platform 11 on the tree T is reached. After reaching the desired elevation, the user removes his feet from the straps 12 whereupon he can then stand or sit on the platform while hunting.

From the foregoing, it will be seen that we have devised an improved hand climber for use with a tree climbing platform. By providing a hand climber wherein two pairs of links are pivotally connected to each other with the forward ends of one pair being slidably connected to an elongated bar and the rear ends of the other pair of links being pivotally connected to each other, our improved hand climber engages the tree at four substantially equally spaced locations whereby the individual links adjust themselves to the contour of the tree to thus encompass and grip the tree upon downward movement of the elongated bar 13. Also, by providing an elongated bar 13 which receives the links 14 and 16 with a sliding fit, the position of the link relative to the bar may be varied as the diameter of the tree varies during the climbing operation. That is, as the user moves up the tree, the diameter of the tree decreases whereby the forward ends of the links 14 and 16 would slide toward each other along the elongated bar 13 to compensate for the reduced diameter. On the other hand, where the diameter of the tree increases as the user moves down the tree, the forward ends of the links 14 and 16 would move away from each other along the elongated bar 13 to compensate for the increased diameter of the tree. Accordingly, an initial adjustment may be made at the time the hand climber is installed on the tree to accommodate trees of various diameters by inserting the bolt 29 in selected ones of the openings 32 and 33. After installation, further adjustment to the contour of the tree is provided by movement of the links 14 and 16 relative to the elongated bar 13 as the user moves up or down the tree. Furthermore, by providing a hand climber which is adapted for movement selectively to an extended operating position and to a collapsed inoperable position, the climber requires a minimum of space for storage and handling.

While we have shown our invention in but one form, it will be obvious to those skilled in the art that it is not so limited but is susceptible of various changes and modifications without departing from the spirit thereof.

What we claim is:

1. For use with a tree climbing platform having a platform adapted to be supported substantially horizontally adjacent the front side of a tree by tree engaging members carried thereby which detachably engage opposite sides of the tree with means for detachably attaching the platform to the feet of a person standing thereon; a hand climber adapted to be positioned on the tree above said platform comprising:

(a) an elongated bar disposed to extend transversely of the front side of a tree, (b) a first pair of links, (c) means slidably connecting one end of each link of said first pair of links to said elongated bar so that said one end of each link of said first pair of links is movable to selected positions along said bar with said bar being forwardly of said tree and the other ends of said first pair of links extending rearwardly along opposite sides of the tree, (d) a second pair of links adapted to extend forwardly along opposite sides of the tree, (e) means pivotally connecting the forward end of each said link of said second pair of links to an adjacent rearwardly extending end of said first pair of links, and (f) means pivotally connecting the rear end of each said link of said second pair of links to each other so that adjacent ones of said links are pivotally connected to each other and adjust themselves to the contour of the tree to thus encompass and grip the tree upon downward movement of said elongated bar.

2. A hand climber for use with a tree climbing platform as defined in claim 1 in which said means pivotally connecting the rear end of each said link of said second pair of links to each other is adjustable to vary the effective lengths of said links of said second pair of links.

3. A hand climber for use with a tree climbing platform as defined in claim 2 in which said means pivotally connecting the rear end of each said link of said second pair of links to each other comprises a removable bolt-like member disposed to engage selected ones of a plurality of longitudinally spaced openings in said second pair of links.

4. A hand climber for use with a tree climbing platform as defined in claim 1 in which said elongated bar extends through openings provided in said one end of each link of said first pair of links with said elongated bar being of a length to extend beyond said first pair of links and provide hand grips.

5. A hand climber for use with a tree climbing platform as defined in claim 4 in which each link of said first pair of links is L-shaped as viewed in cross section to provide vertical and horizontal flanges with said openings for said elongated bar being in the vertical flanges and the edges of the horizontal flanges being in position to engage the side of a tree.

6. A hand climber for use with a tree climbing platform as defined in claim 1 in which each link of said second pair of links is a flat member which extends in a generally horizontal plane so that said second pair of links are movable selectively to a collapsed position and an extended position relative to each other and relative to said first pair of links.

* * * * *